United States Patent [19]

Becker

[11] 4,437,360

[45] Mar. 20, 1984

[54] APPARATUS FOR CONTROLLED STOPPER EXTRACTION FROM AND REINSERTION IN SPARKLING WINE BOTTLES

[76] Inventor: Hal C. Becker, 4104 Sumter Sq., Fort Collins, Colo. 80525

[21] Appl. No.: 469,198

[22] Filed: Feb. 23, 1983

[51] Int. Cl.[3] ..... B67B 7/06; B67B 7/44

[52] U.S. Cl. ..... 81/3.44; 81/3.1 R

[58] Field of Search ..... 81/3.34, 3.4, 3.42, 81/3.44, 3.46 R, 3.1 R; D8/33, 39, 40, 18

[56] References Cited

U.S. PATENT DOCUMENTS

| | | | |
|---|---|---|---|
| 2,516,439 | 7/1950 | Whiteley | 81/3.46 R |
| 2,564,536 | 8/1951 | Lepkowski | 81/3.46 R |
| 2,811,061 | 10/1957 | Radovich | 81/3.46 R |
| 3,722,327 | 3/1973 | Scharwat | 81/3.1 R |
| 4,018,110 | 4/1977 | Spriggs | 81/3.1 B |

FOREIGN PATENT DOCUMENTS

| | | | |
|---|---|---|---|
| 655401 | 1/1938 | Fed. Rep. of Germany | 81/3.44 |

*Primary Examiner*—Roscoe V. Parker
*Attorney, Agent, or Firm*—James B. Lake, Jr.

[57] ABSTRACT

A strip of tensile material is transversely bent in the middle to form equal elongated upper and lower flat members that are longitudinally parallel with free handle ends oppositely disposed to the bent closed end. The members are spaced apart the height of a sparkling wine bottle stopper head for receiving the head therebetween. The lower member, adjacent the curved end, defines a compound hole comprising contiguous holes of unequal radii longitudinally oriented and adapted respectively to receive a stopper head through the larger hole and for the smaller hole to engage around the stopper body, slidably. Moving the handle ends back and forth and up and down moves the stopper as desired under complete control regardless of the lack of engaging pressure on the handle ends, and without force engaging the bottle.

2 Claims, 4 Drawing Figures

APPARATUS FOR CONTROLLED STOPPER EXTRACTION FROM AND REINSERTION IN SPARKLING WINE BOTTLES

BACKGROUND OF THE INVENTION

The invention relates generally to a bottle stopper extractor and more particularly to an apparatus and method for controlling stopper extraction and reinsertion in sparkling wine bottles.

The amount of force required and the difficulty of application is well known. The prior art discloses Scharwat nee Strassel, U.S. Pat. No. 3,722.327 and Spriggs, U.S. Pat. No. 4,018,110. Both teach plier type cork pullers that engage oppositely disposed sides of a stopper head to pull a stopper normal to the retaining pressure of the jaws on the stopper head, and that use the top of the bottle neck as a fulcrum in pulling the stopper.

The invention teaches an apparatus and method that engages a stopper between parts exerting retaining pressure in line with the direction of extraction and reinsertion of the stopper and that does not fulcrum on the bottle neck.

SUMMARY OF THE INVENTION

It is an object of the invention to provide a stopper extractor and reinserter in which an engaging part thereof opposes the escape of an engaged stopper whatever the retaining pressure exerted thereon by the extracter and reinserter.

Another object of the invention is to extract and reinsert stoppers by leverage without fulcruming on the bottle neck.

DETAILED DESCRIPTION OF THE PREFERRED EMBODIMENT

Figure 1:
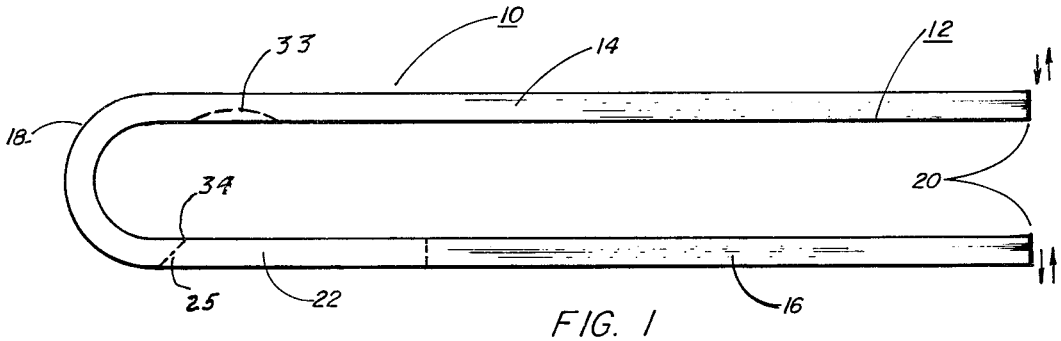
FIG. 1 is a side elevation of the invention.
Figure 2:
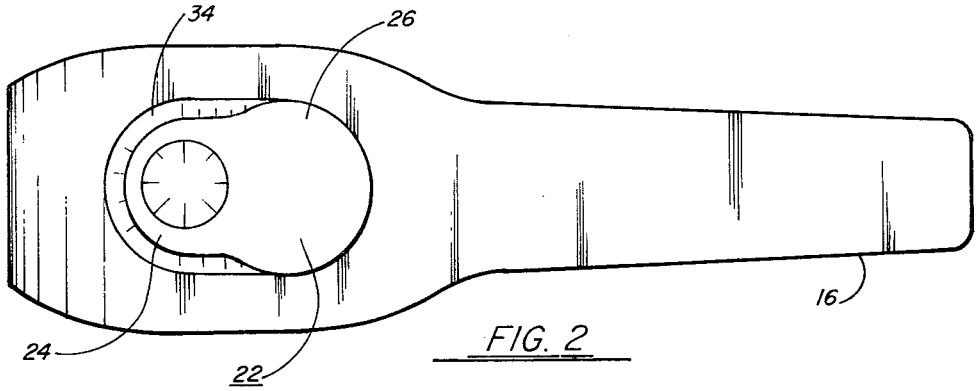
FIG. 2 is a bottom view of the invention.

Referring to FIGS. 1 and 2, the sparkling wine bottle stopper extractor and reinserter 10, comprises an elongated strip 12 of tensile material bent to form two equal and parallel members 14 and 16 with a closed stopper retaining forward end 18 and rear free handle ends 20. A compound hole 22 is defined by member 16 adjacent said closed end 18, and comprises two contiguous holes 24 and 26 longitudinally oriented with forward hole 24 having a diameter to engage a stopper body 28, and a rear hole 26 having a diameter to receive a stopper head 30 of a sparkling wine bottle 32. Member 14 defines a hollow 33 in its inner surface opposite and aligned with forward hole 24.

Elongated strip 12 can be of any tensile material, metal or plastic, that can be moulded, bent or formed into the tapered and curved members 14 and 16 as shown in FIGS. 1 and 2. Closed forward end 18 is bent or curved with a diameter equal to the height of stopper head 30. Free handle ends 20 can be biased open and closed to accommodate outsized stopper heads.

Compound hole 22 is positioned adjacent to closed end 18 to provide maximum leverage of handle ends when manually biased. Hole 24 has a chamfer 25 partially around its lower edge 34 for engaging around the lower surface of stopper head 30 without fulcrumming on bottle neck 36 of bottle 32 to extract and reinsert a stopper 37.

Figure 3:
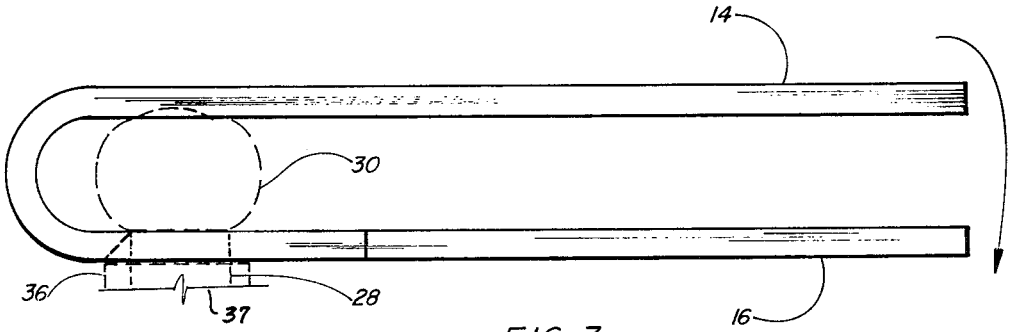
FIG. 3 is similar to FIG. 1 with invention in operational engagement with a stoppered sparkling wine bottle partially show.
Figure 4:
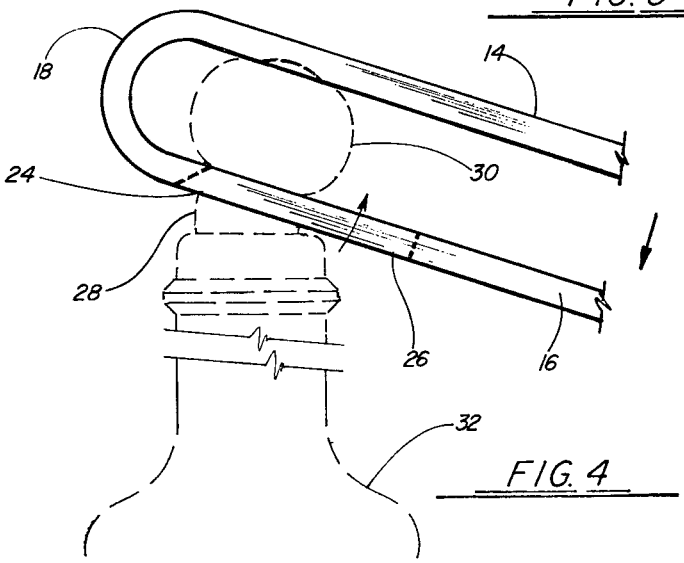
FIG. 4 is a partial view of the matter of FIG. 3 showing stopper partially extracted.

Referring also to FIGS. 3 and 4, stopper extractor and reinserter 10 in operation is held in any convenient hand by the rear free handles 20. For extraction, the stopper head is inserted into rear contiguous hole 26 and slipped forwardly for stopper body to be engaged by the chamfered edge 34 of forward hole 24, and the top of stopper head in hollow 33 of member 14. The stopper is loosened in the bottle neck by circumferentially moving the handle ends, and then drawn by depressing the ends together, the stopper being drawn sideways and the bottle neck extending through rear contiguous hole 26 without force engaging the bottle neck.

To reinsert stopper, it is manually placed between members 14 and 16 in the same relative position thereto as when drawn, and the stopper end placed in the mouth of the sparkling wine bottle and held for reentry therein by manually engaging the free handle ends with the bottle standing upright on a rigid surface. A quick downward push or blow with the free hand inserts the stopper into the bottle neck up to the stopper head. The free handles are relaxed and the extractor and inserter 10 slid forwardly to allow disengagement of the stopper through rear hole 26.

In both the above operations the stopper has no chance of escaping from between the members 14 and 16 regardless of the stopper engaging pressure exerted, or lack of it, because of the inertia of one of said members in the line of operation overcoming any excess gas pressure in the sparkling wine bottle tending to expel the stopper with high velocity.

What is claimed is:

1. Apparatus for controlled stopper extraction from and reinsertion in sparkling wine bottles comprising:

(a) bifurcated tensile engaging means, having two parallel member means spaced apart by a closed curved end, and having oppositely disposed free handle ends for tensilely increasing and decreasing said spacing;

(b) one said member means defines a compound hole means of two contiguous holes, one hole for passing a stopper head and the other for slidably engaging said stopper body and stopper head lower edges;

(c) a second said member means defining a hollow opposing said other contiguous hole for simultaneously engaging said stopper top as said one said member means other hole slidably engages said stopper body.

2. Apparatus as described in claim 1 wherein said one member means other contiguous hole is externally chamfered for engaging said stopper head lower edges without engaging said sparkling wine bottle neck.

* * * * *